US006276181B1

(12) United States Patent
Kusakabe

(10) Patent No.: US 6,276,181 B1
(45) Date of Patent: Aug. 21, 2001

(54) THREE-ROLL-TYPE REDUCING MILL FOR ELECTRO-RESISTANCE-WELDED TUBE

(75) Inventor: Yukio Kusakabe, Kobe (JP)

(73) Assignee: Kusakabe Electric & Machinery Co., Ltd., Kobe (JP)

( * ) Notice: Subject to any disclaimer, the term of this patent is extended or adjusted under 35 U.S.C. 154(b) by 0 days.

(21) Appl. No.: 09/603,992

(22) Filed: Jun. 27, 2000

(51) Int. Cl.[7] ..... B21B 13/10
(52) U.S. Cl. ..... 72/224; 72/235; 72/237
(58) Field of Search ..... 72/224, 225, 226, 72/235, 237, 247

(56) References Cited

U.S. PATENT DOCUMENTS 3,584,490 * 6/1971 Bindernagel ..... 72/224
3,987,657 * 10/1976 Properzi ..... 72/224
4,313,325 * 2/1982 Staat et al. ..... 72/224
4,569,217 * 2/1986 Properzi ..... 72/224
6,116,071 * 9/2000 Cernuschi et al. ..... 72/224

FOREIGN PATENT DOCUMENTS

3143244 A1 * 5/1983 (DE) ..... 72/224
9-262620 7/1997 (JP) .

* cited by examiner

*Primary Examiner*—Ed Tolan
(74) *Attorney, Agent, or Firm*—Sterne, Kessler, Goldstein & Fox P.L.L.C.

(57) ABSTRACT

A three-roll-type reducing mill including three forming rolls brought into contact with an outer periphery of an electro-resistance-welded steel tube for reducing its diameter. Two left and right sliding brackets respectively mounted with two follower forming rolls are sidden symmetrically with respect to a center of a main forming roll and simultaneously only by rotation of a single adjusting screw shaft, thereby enabling the diametrical reduction of the steel tube to be adjusted on-line and speedily.

5 Claims, 14 Drawing Sheets

THREE-ROLL-TYPE REDUCING MILL FOR ELECTRO-RESISTANCE-WELDED TUBE

BACKGROUND OF THE INVENTION

1. Field of the Invention

The present invention relates to a reducing mill disposed at the rear of a plant for manufacture of electro-resistance-welded steel tubes wherein a narrow and long successive steel plate (a strip) is gradually formed into a cylindrical shape, seam-welded, and then, reduced with its diameter by the reducing mill.

2. Related Art

A previous reducing mill having three rolls (three-roll-type reducing mill) comprised a stand supporting three rolls exclusive to each product size. If the rolls have worn away, the stand supporting the rolls is replaced with another stand supporting new three rolls. The worn rolls are ground and the stand having the rolls is used for diametrically larger products.

Later, the three-roll-type reducing mill has been improved so that its stand is provided with mechanisms for adjusting the position of the roll to mill a formed electro-resistance-welded tube into various sizes, as disclosed in an earlier application (Japanese Patent Application Laid-Open No. 9-262620) filed by the present applicant.

For the purpose of prevention of an irregularity or a flaw on an outer surface of a finished tube caused by positional difference between adjacent rolls in a radial direction of the tube, it is important for adjustment of a caliber formed by the three forming rolls of the three-roll-type reducing mill corresponding to a reduced diameter of a steel tube that each of two positionally-adjustable forming rolls is moved along a tangent to a curve of a positionally-fixed forming roll adjacent thereto for abutting against an objective tube at each of opposite ends of the positionally-fixed forming roll, in other words, along a direction at a 30° angle from a radial line of the positionally-fixed forming roll across the center of the objective tube.

This reducing mill comprises three rotary shafts; one is a drive shaft for one positionally-fixed main forming roll, and the other two are follower shafts for respective positionally-adjustable follower forming rolls which are driven by the drive shaft through respective bevel gears. Each rotary shaft is disposed in parallel to a shaft serving as an axis of a roll (a roll-axis shaft) on which each roll is fixed and drivingly connected with the roll-axis shaft through gears, so that the roll-axis shaft can be axially moved within the backlash between the gears. Also, the roll-axis shaft can be moved in perpendicular to its axis (radially) by sliding means. A movement of each of the follower forming rolls along a tangent to the curve of the main forming roll for abutting against an objective tube at each of the opposite ends of the main forming roll results from the two axial and radial movements of the roll-axis shaft.

However, since the axial movement of the roll-axis shaft and the radial movement thereof are independent of each other, each of the follower forming rolls, actually, cannot move straightly along the above-mentioned tangent. It is difficult to adjust the position of each of the follower forming rolls along the tangent exactly and for a short time by two operations for different movements of the roll-axis shaft of the follower forming roll. Furthermore, a proper positional adjustment of the follower forming rolls for the moment cannot be made during the processing of the reducing mill under inspection of finished products, even if any problem is found on the product finished by the reducing mill. It is only possible that a stand structure supporting the three forming rolls is adjusted with its two follower forming rolls in their positions before its incorporation into the plant for manufacture of electro-resistance-welded steel tubes or while the reducing mill or the entire plant is shut down in power for required adjustment thereof.

SUMMARY OF THE INVENTION

According to the present invention, there is provided a three-roll-type reducing mill including three forming rolls disposed at regular intervals so as to arrange their axes in an equilateral triangle shape and brought into contact with an outer periphery of an electro-resistance-welded steel tube so as to mill the tube into round while reducing the diameter thereof, wherein one of the three forming rolls is a main forming roll fixed in position, the other two forming rolls are follower forming rolls drivingly following the main forming roll, and both of the follower forming rolls can be moved simultaneously with each other and symmetrically with respect to a center of the main forming roll along respective tangents to a curve of the main forming roll for abutting against the electro-resistance-welded steel tube at two opposite ends of the main forming roll. Thus, positions of the follower forming rolls can be changed while transmitting rotation driving force from the main forming roll to the follower forming rolls and the diametrical reduction of the steel tube can be adjusted without generating an irregularity or a flaw in an outside shape of the milled steel tube.

Furthermore, according to the invention, the pair of left and right follower forming rolls are respectively supported by sliding brackets, both the sliding brackets are respectively, in slidable contact with a pair of left and right tapered blocks screwed onto an adjusting screw shaft, and the tapered blocks are simultaneously moved oppositely to each other along said adjusting screw shaft whether toward each other or away from each other by rotation of the adjusting screw shaft. Thus, it is possible to slide the sliding brackets symmetrically concerning a center of the main forming roll and in the same movements by only rotating the single adjusting screw shaft, so that a fine adjustment of the diameter of the finished product can be made swiftly while inspecting the diameter during the process by the reducing mill.

Additionally, according to the present invention, each of the sliding brackets is formed with a sliding face in parallel to each of the tangents, and a stand structure supporting the three forming rolls is formed with a pair of left and right sloped faces in parallel to the respective tangents, so that the sloped faces are brought into slidable contact with the sliding faces of the respective sliding brackets. Therefore, the sliding brackets are moved along the respective tangents while their sliding faces slide on the respective sloped faces during the movement of the tapered blocks by rotational operation of the adjusting screw shaft.

In addition to the above adjustment on basis of the inspection of the diameter on-line, the adjustment of roll positions can be also made corresponding to a difference of a springback caused by variation of the steel in material, thereby maintaining an extremely satisfactory accuracy of the finished diameter of the product.

Other objects, features and advantages of the present invention will become clear from the following description by reference to the accompanying drawings.

DETAILED DESCRIPTION OF THE PREFERRED EMBODIMENT

Figure 1:
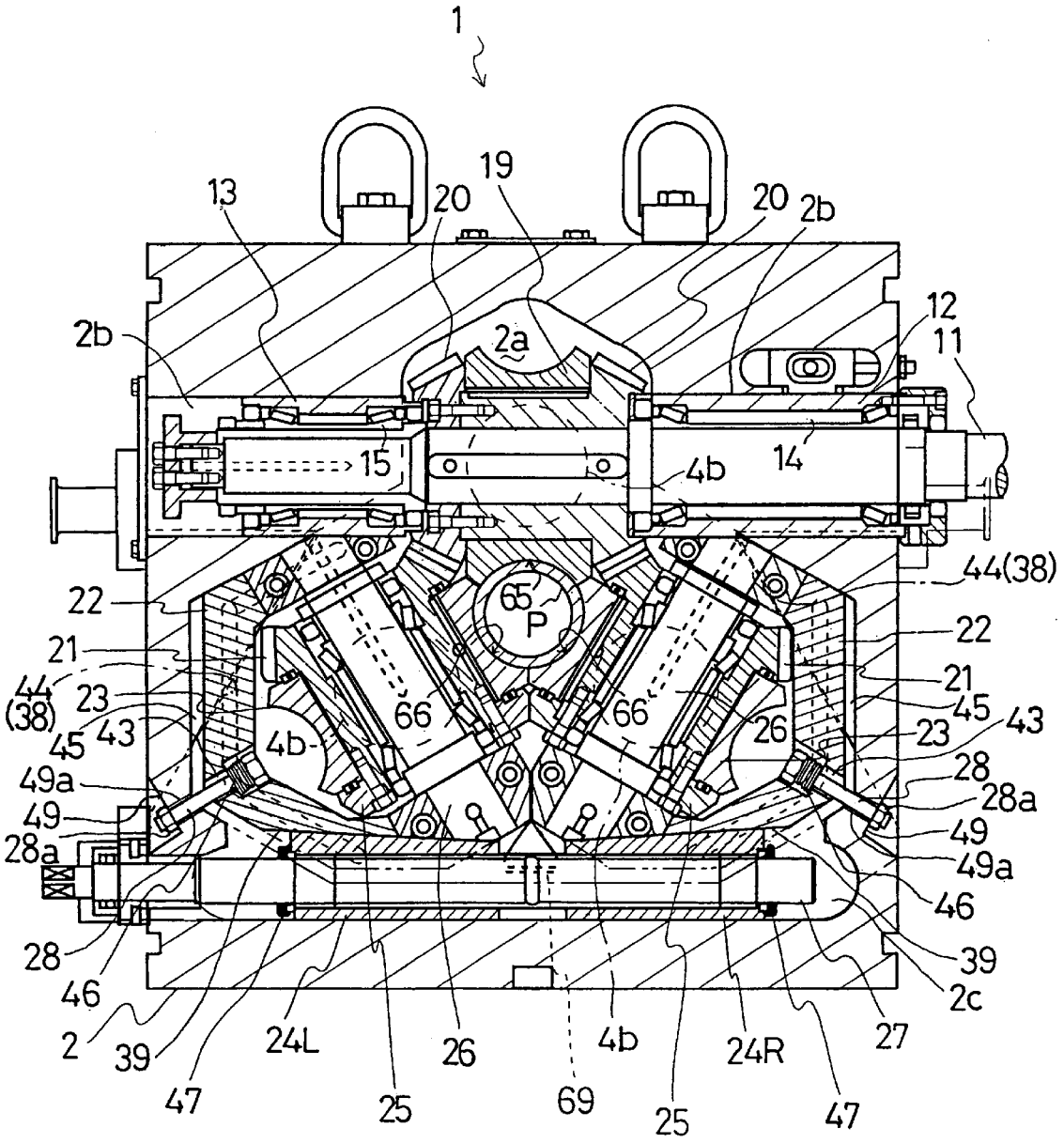
FIG. 1 is a sectional front view of a three-roll-type reducing mill provided with a roll-positioning structure according to the present invention.
Figure 2:
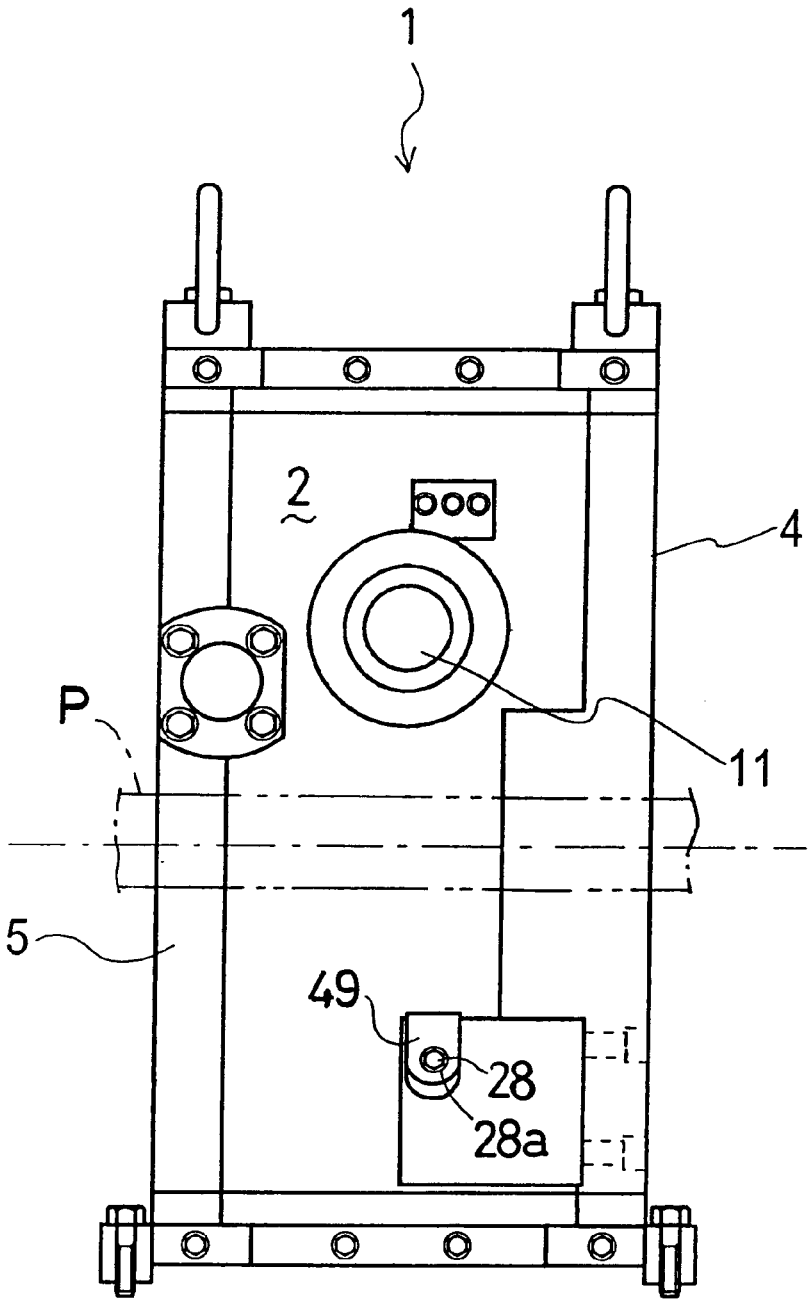
FIG. 2 is a right side view of the same.

As shown in FIG. 1, a three-roll-type reducing mill 1 of the present invention having one main forming roll 19 and two follower forming rolls 23 is provided for reducing a diameter of an electro-resistance-welded steel tube P by use of rotation of the three forming rolls 19 and 23.

First, description will be given on a stand structure of a three-roll-type reducing mill 1 of the present invention comprising a main frame 2, a rear cover 4 and a front cover 5 in accordance with FIGS. 1 to 5.

Figure 3:
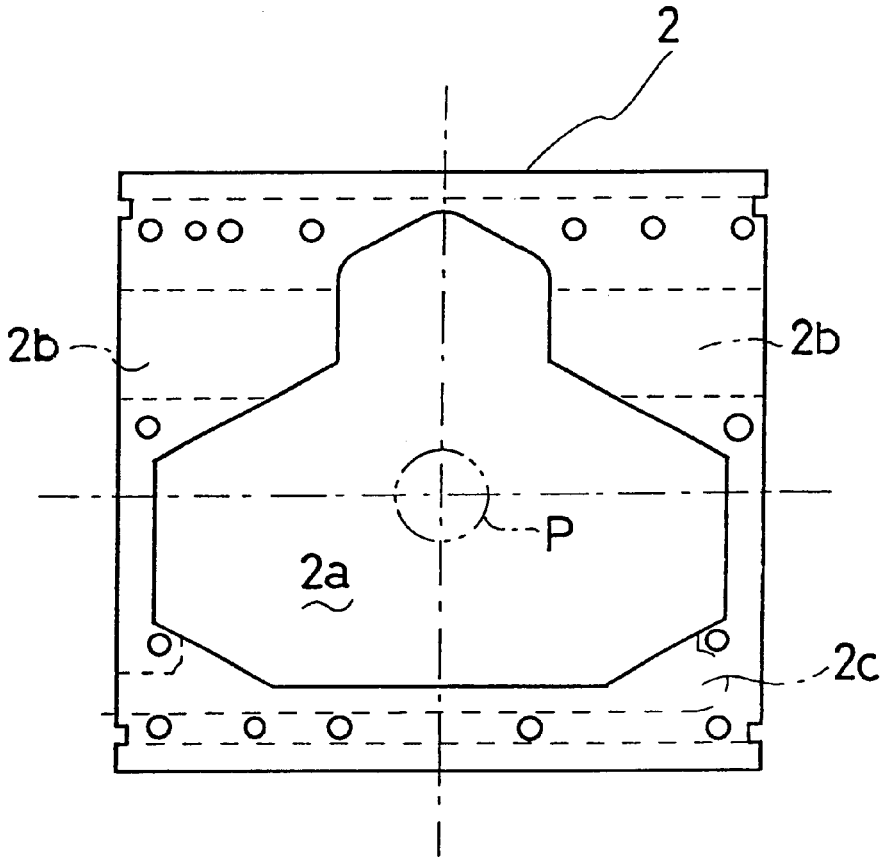
FIG. 3 is a front view of a main frame 2 of the reducing mill.

As shown in FIG. 3, the main frame 2, which is formed of cast steel material, is provided with a main chamber 2*a* and a pair of left and right colxial drive shaft holes 2*b* by machine work. The main chamber 2*a* is open at both the front and rear surfaces of the main frame 2. The drive shaft holes 2*b* are extended laterally from an upper portion of the main chamber 2*a* to be open at respective left and right surfaces of the main frame 2. The main chamber 2*a* is partly extended downward so as to form a lower chamber 2*c*, which is open at one of left and right sides of the main frame 2. Left and right outer sides of the main frame 2 are symmetrically notched slantwise so as to make left and right stays 49, at which respective female screws 49*a* are open and bored through the main frame 2 to the main chamber 2*a*.

Figure 4:
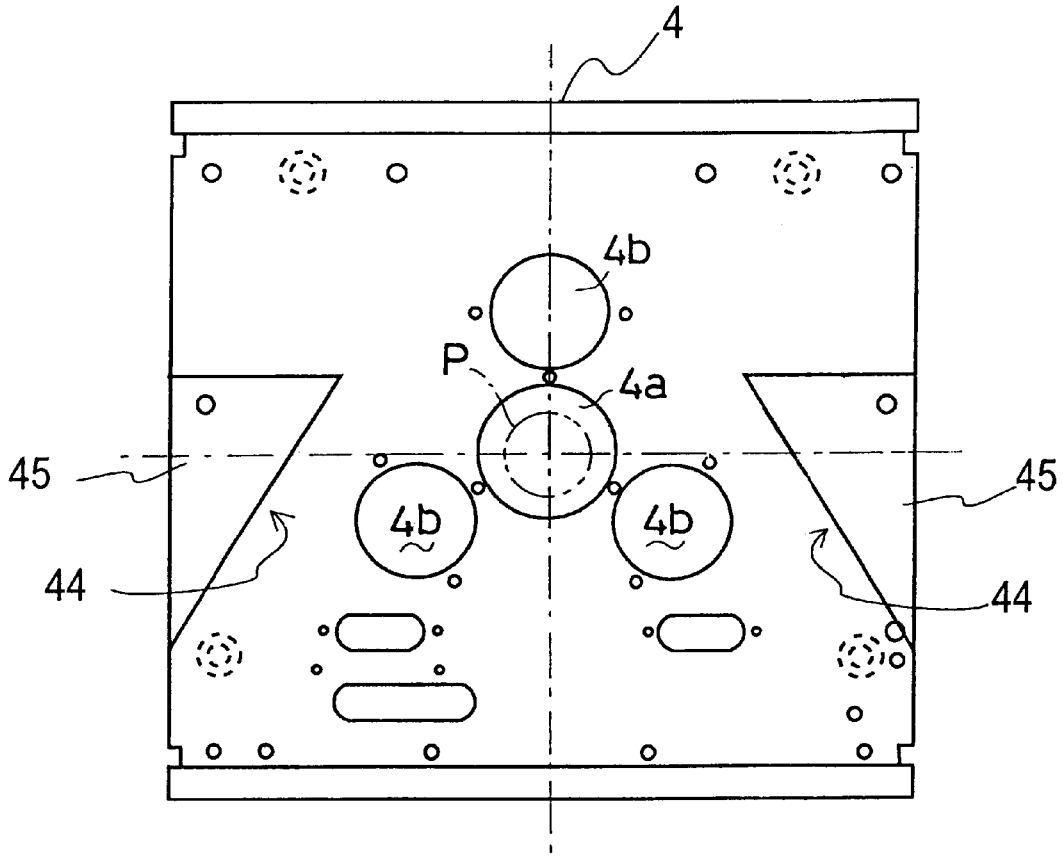
FIG. 4 is a front view of a rear cover 4 of the reducing mill.

As shown in FIG. 4, the rear cover 4 is provided at the center portion thereof with a central hole 4*a*, through which an electro-resistance-welded steel tube P is passed and drawn, and three holes 4*b* for inspection and repair of the forming rolls 19 and 23 around the central hole 4*a*. To opposite sides of the rear cover 4 are further formed a pair of triangular stays 45 in a three-dimensional manner by skiving. A sloped face 44 of each of the triangular stays 45 is to be a slide guide for a sliding bracket (chock) 22 serving as a part of a positioner of the follower forming roll 23, as discussed below. There is made a 30° angle between the sloped face 44 and a vertical line.

Figure 5:
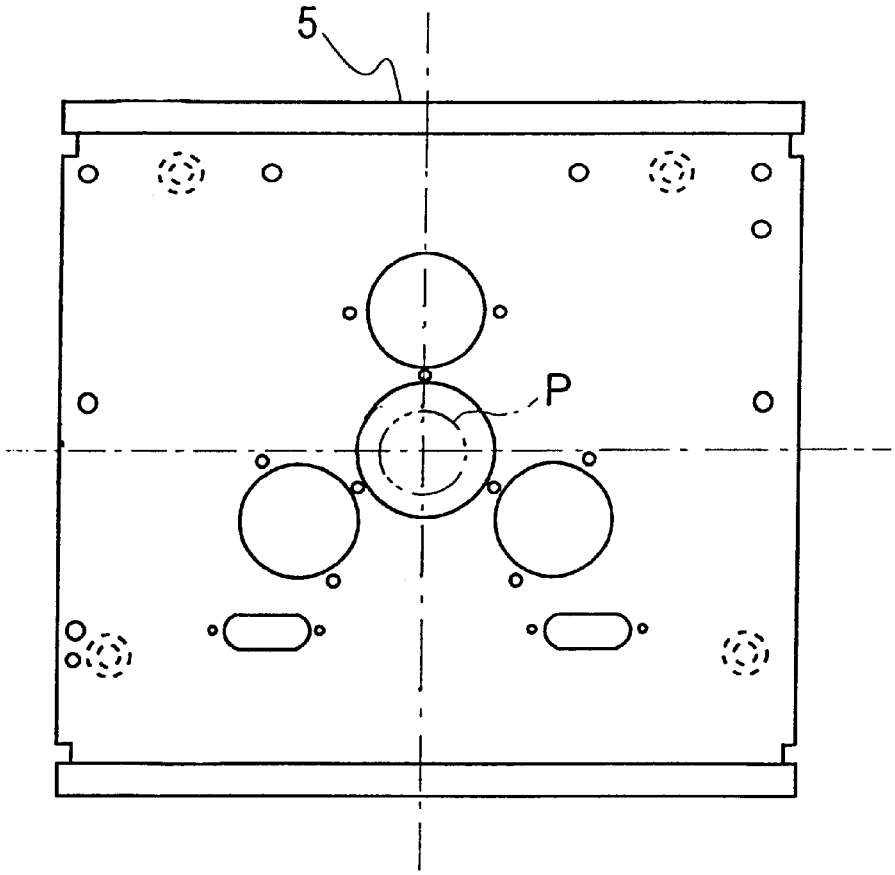
FIG. 5 is a front view of a front cover 5 of the reducing mill.

The front cover 5 has a shape corresponding to the rear cover 4 as shown in FIG. 5 but is not provided with the triangular stays 45.

Onto rear and front surfaces of the main frame 2 are screwed the rear cover 4 and the front cover 5. Left and right surfaces of the main frame 2 are respectively covered with side covers (not shown) which have respective openings in direct connection with outer ends of the drive shaft holes 2*b*.

Description will now be given on the arrangement of the three forming rolls 19 and 23 in the above-mentioned stand structure.

Figure 6:
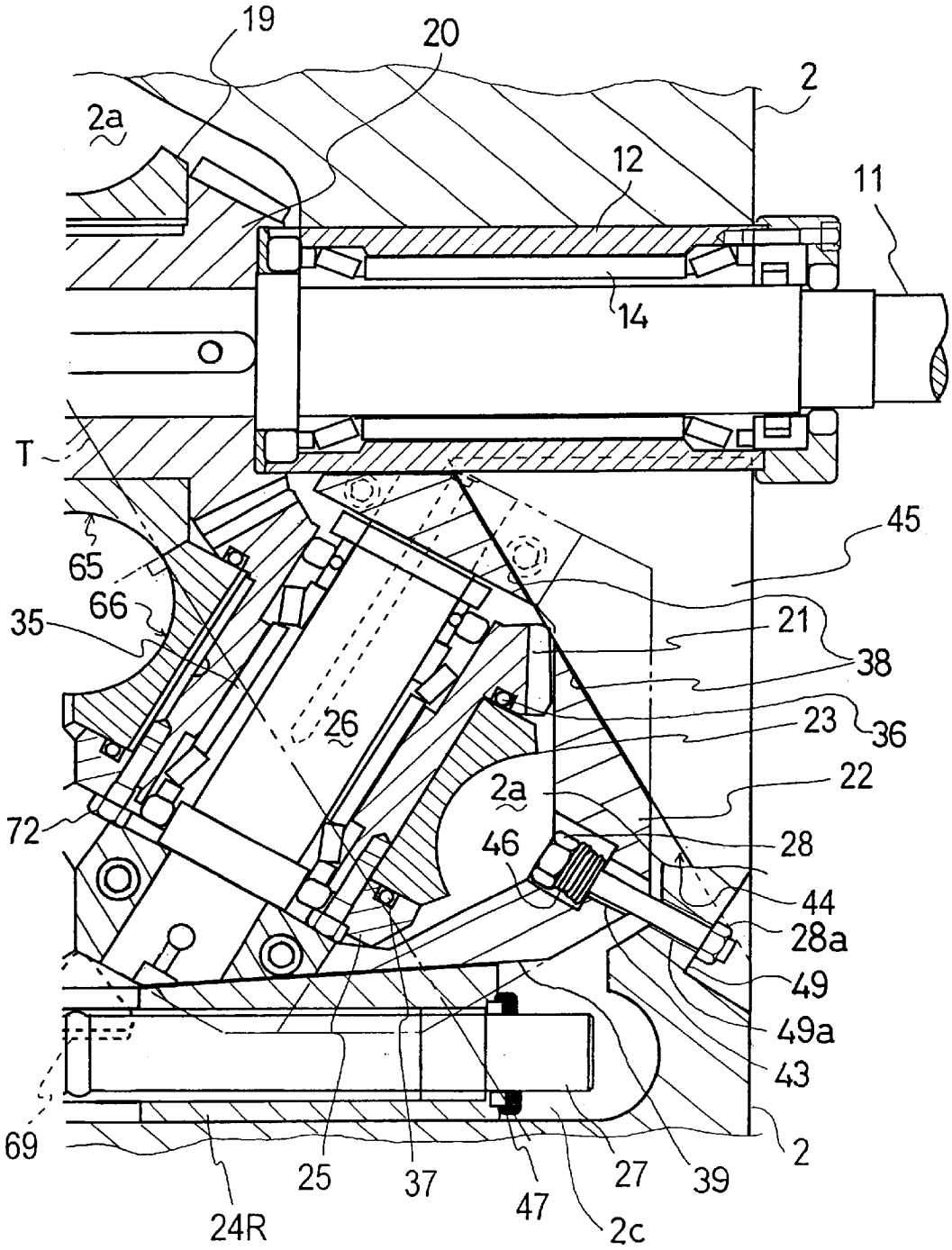
FIG. 6 is a sectional front view of a principal portion of a right follower roll 23 with its positioning mechanism and its surroundings in the reducing mill.

As shown in FIGS. 1 and 6, in both the drive shaft holes 2*b* of the main frame 2 are fixedly disposed cylindrical shaft casings 12 and 13. A drive shaft 11 is laterally extended through both the shaft casings 12 and 13 and through the upper portion of the main chamber 2*a* between the shaft casings 12 and 13. Between each of the shaft casings 12 and 13 and the drive shaft 11 is interposed each of taper roller bearings 14 and 15, so that the drive shaft 11 is rotatably supported in the main frame. In the upper portion of the main chamber 2*a* are disposed a pair of main bevel gears 20 which are fixed on the drive shaft 11. The main forming roll 19 is fixedly fitted between the main bevel gears 20. The drive shaft 11 is rotated by power of a motor (not shown).

In the lower left and right symmetrical portions of the main chamber 2*a* are disposed a pair of follower shafts 26, respectively, so that the drive shaft 11 and the two follower shafts 26 are arranged in an equilaterally triangular shape. On each of the follower shafts 26 is rotatably disposed a follower bevel gear 21. Onto the follower bevel gear 21 is fixedly fitted the follower forming roll 23. Therefore, the follower forming roll 23 is rotatable together with the follower bevel gear 21 around the follower shaft 26.

Figure 7:
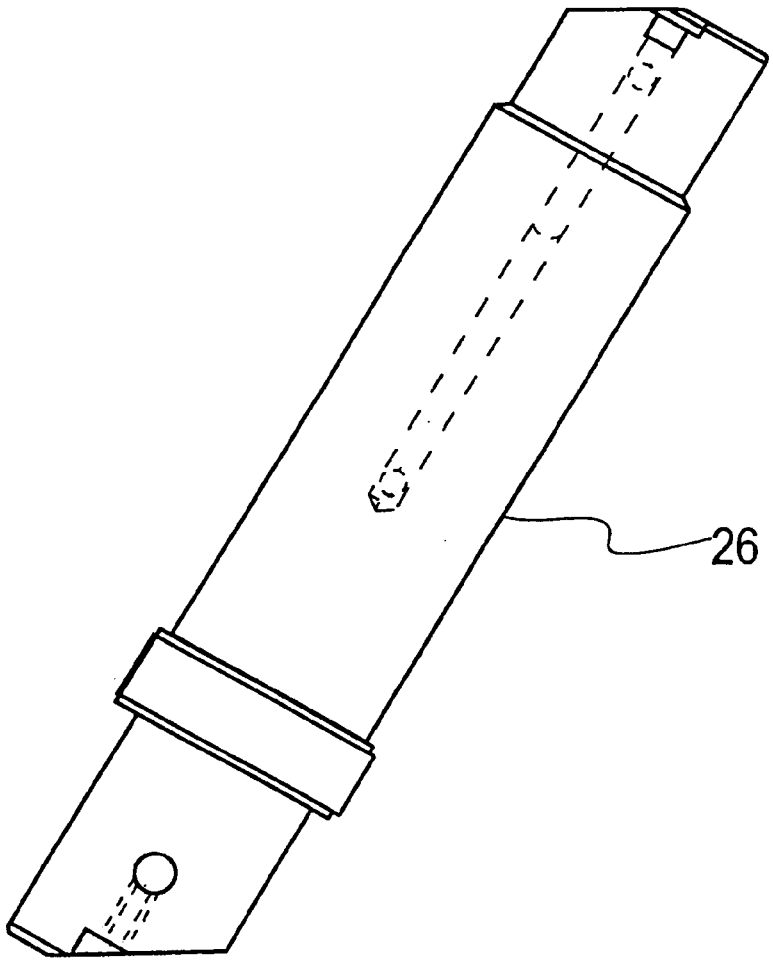
FIG. 7 is a front view of a follower shaft 26 of the reducing mill.
Figure 8:
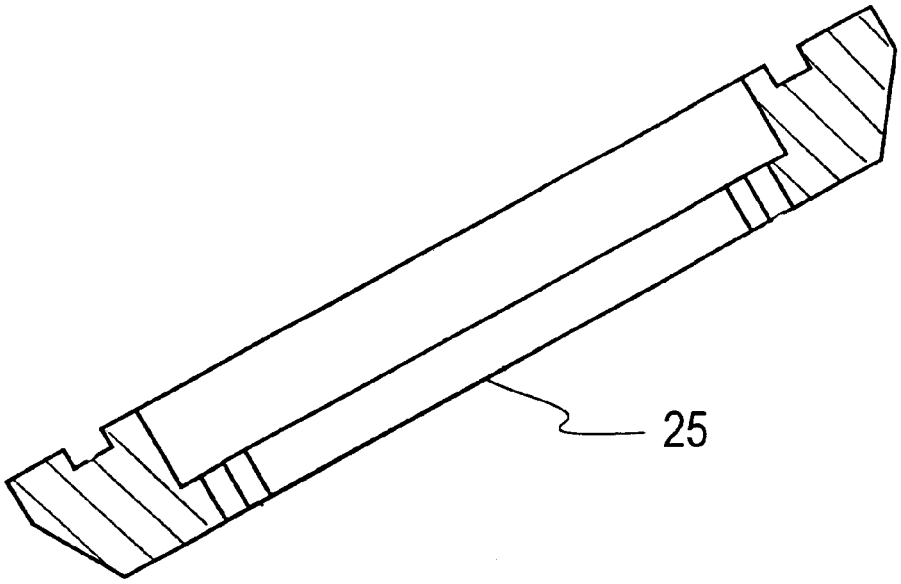
FIG. 8 is a sectional front view of a collar 25 of the reducing mill.
Figure 9:
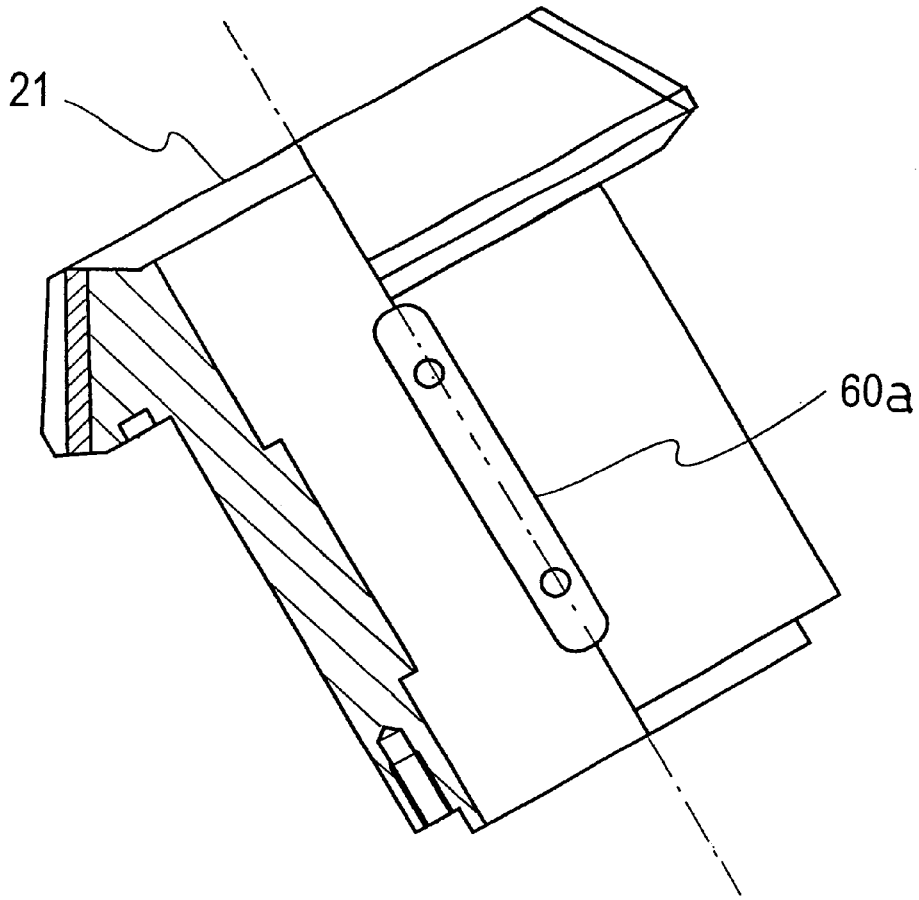
FIG. 9 is a front view, partly in section, of a follower bevel gear 21 of the reducing mill.
Figure 10:
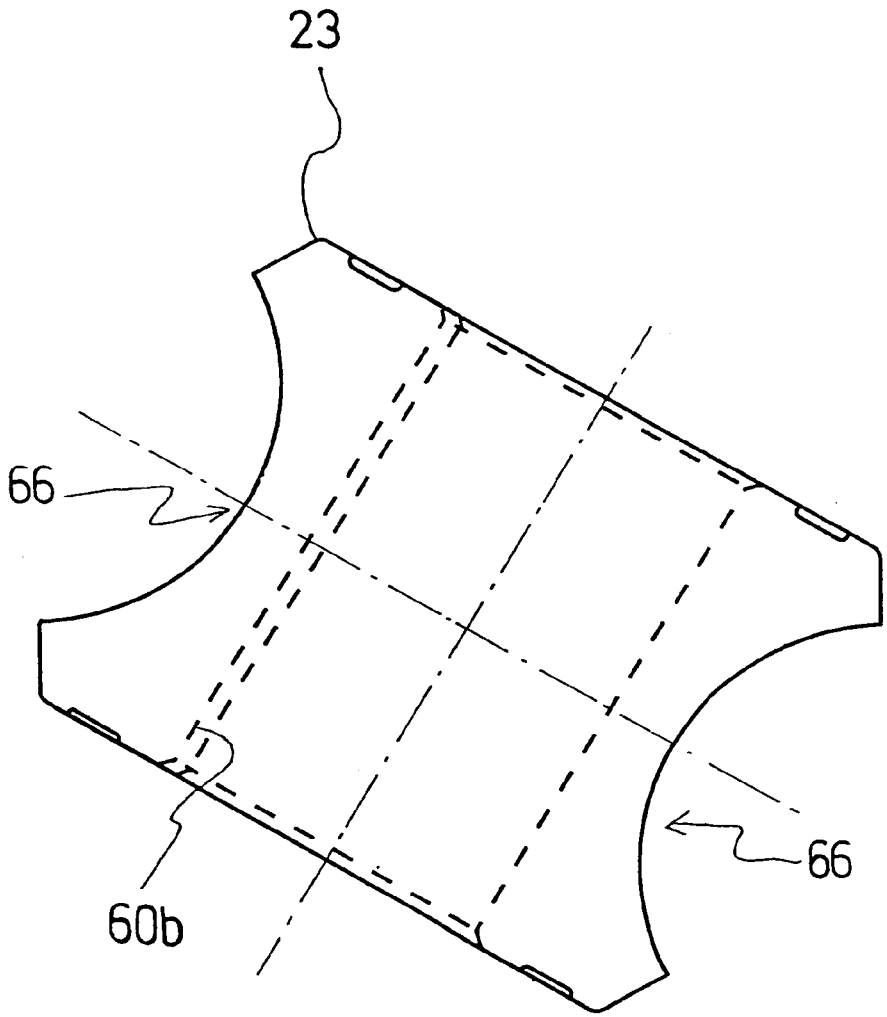
FIG. 10 is a front view of a follower forming roll 23 of the reducing mill.

In detail, as shown in FIGS. 6 and 9, a cylindrical barrel portion is integrally extended from each of the follower bevels gears 21. A collar 25 (as shown in FIG. 7) is screwed to an end of the barrel portion of the follower bevel gear 21 by using bolts 72 as shown in FIG. 6. The collar 25 and the follower bevel gear 21 are rotatably disposed around each of the follower shafts 26 through a taper roller bearing 35. A key groove 60*a* is formed at an outer surface of the barrel portion of the follower shaft 26 as shown in FIG. 9, and a key groove 60*b* is formed at an inner peripheral surface of the follower forming roll 23 as shown in FIG. 10. The follower forming roll 23 is substantially fixedly disposed around the barrel portion of the follower bevel gear 21 through a key disposed in the key grooves 60*a*and 60*b* coinciding with each other, so that the follower forming roll 23 is sandwiched between the follower bevel gear 21 and the collar 25. As shown in FIG. 6, an O-ring 36 is interposed between the follower bevel gear 21 and the follower forming roll 23, and an O-ring 37 is between the follower forming roll 23 and the collar 25.

The pair of main bevel gears 20 mesh with the respective follower bevel gears 21 so as to transmit the rotation of the drive shaft 11 to the left and right follower forming rolls 23. Therefore, when the drive shaft 11 is rotated by the motor, the main forming roll 19 rotates together with the drive shaft 11, and simultaneously, the left and right follower forming rolls 23 rotates around the respective follower shafts 26 by the meshing of bevel gears 20 and 21.

As shown in FIG. 1, the three forming rolls 19 and 23 are disposed at regular intervals, so that a curve 65 of the main forming roll 19 and curves 66 of the two follower forming rolls 23, when viewed in front, for abutting against an electro-resistance-welded steel tube P are arranged so as to form a longitudinally cylindrical pathway corresponding to a predetermined caliber through which the steel tube P is drawn so as to be reduced with its diameter. As shown in FIG. 6, a tangent T to an outer periphery of the pathway (the curve 65) when viewed in front at each of opposite end points of the main forming roll 19 adjacent to the end of each of the follower forming rolls 23 is directed at a 30° angle from a vertical line, thereby being parallel to the sloped face 44 of the triangular stay 45.

An electro-resistance-welded steel tube P is supplied into the pathway formed by the three forming rolls 19 and 23, so that, during its longitudinal movement through the pathway, the diameter of the steel tube P is gradually reduced by the three rotating forming rolls 19 and 23. The caliber of the pathway can be adjusted by the positioning of the follower forming rolls 23 with respect to the positionally-fixed main forming roll 19, so as to adjust the reduced diameter of the steel tube P. Moreover, in the positional adjustment of the follower forming rolls 23, the follower forming rolls 23 are slidden along the respective sloped faces 44, i.e., the respective tangents T, whereby the main forming roll 19 and each of the follower forming rolls 23 are prevented from positional difference therebetween in a radial direction of the pathway, thereby preventing the milled steel tube P from irregularities or flaws thereon.

The positioning mechanisms for the two follower forming rolls 23 will be described. In the description, only a reference to a right sliding bracket 22 and a right tapered block 24R in accordance with FIGS. 6 and 11 to 15 is to be applied to description of a left sliding bracket 22 and a left tapered block 24L, because the two follower forming rolls 23 and the positioning mechanisms thereof are laterally symmetrically constructed and disposed in the main chamber 2*a* and the lower chamber 2*c* of the main frame 2 with respect to the positionally-fixed main forming roll 19.

Figure 11:
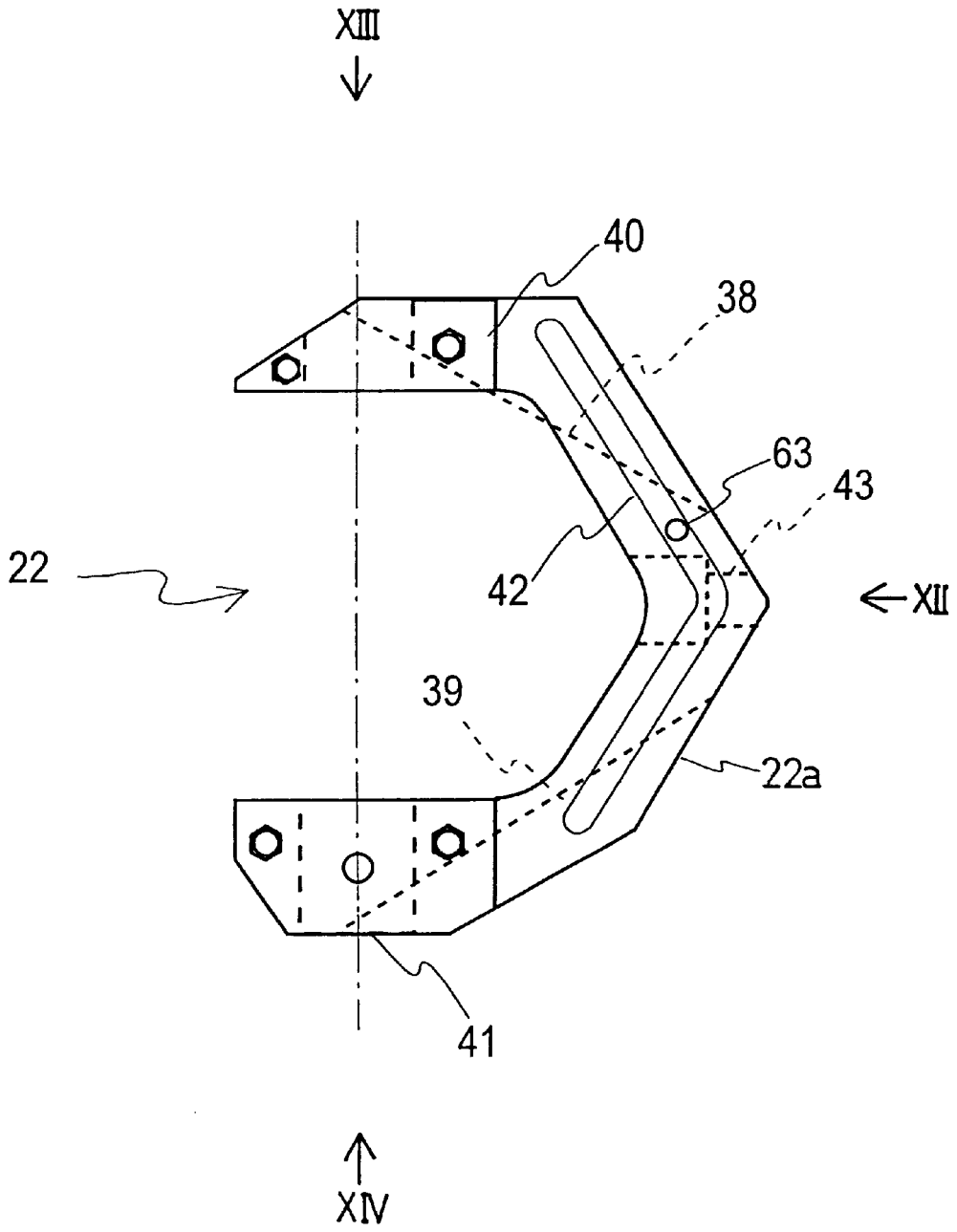
FIG. 11 is a front view of a sliding bracket (chock) 22 of the reducing mill.
Figure 12:
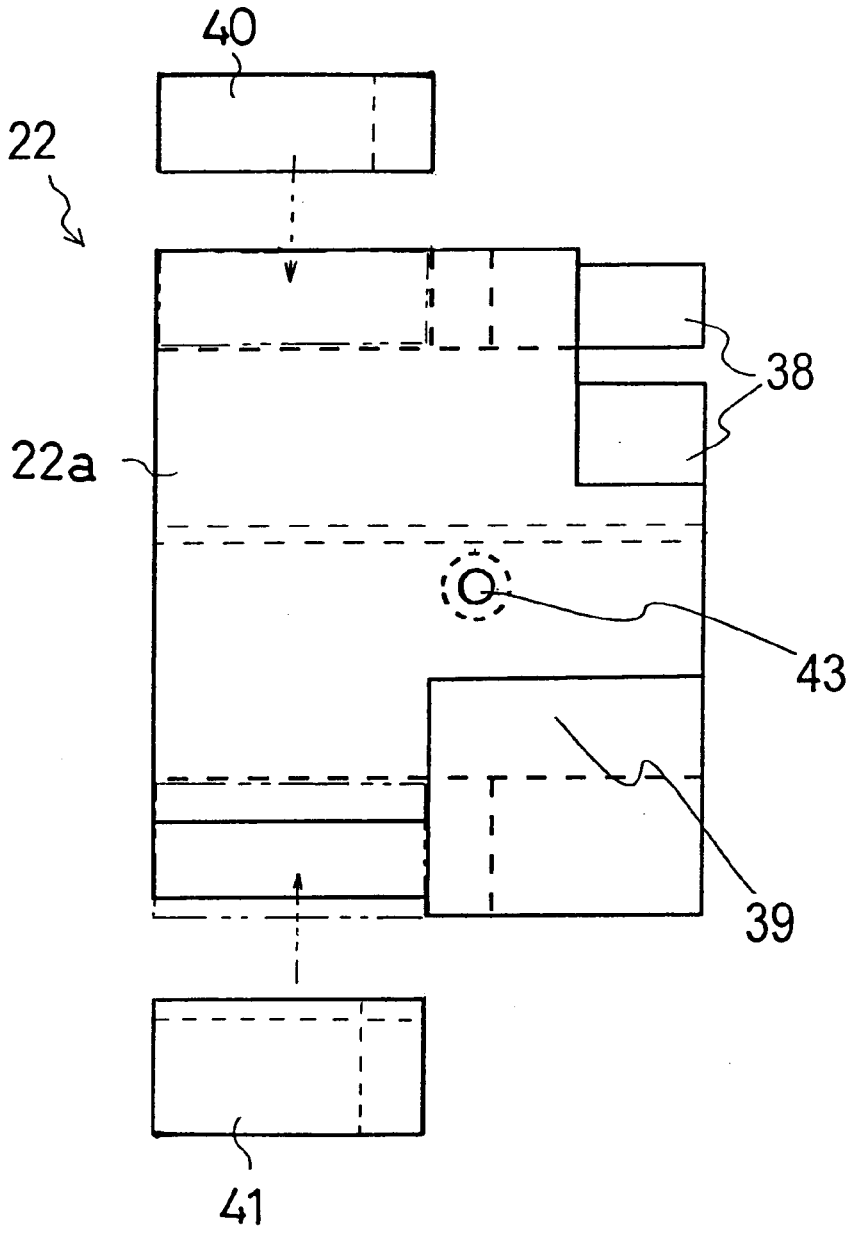
FIG. 12 is an exploded view taken in a direction of an arrow XII in FIG. 11.
Figure 13:
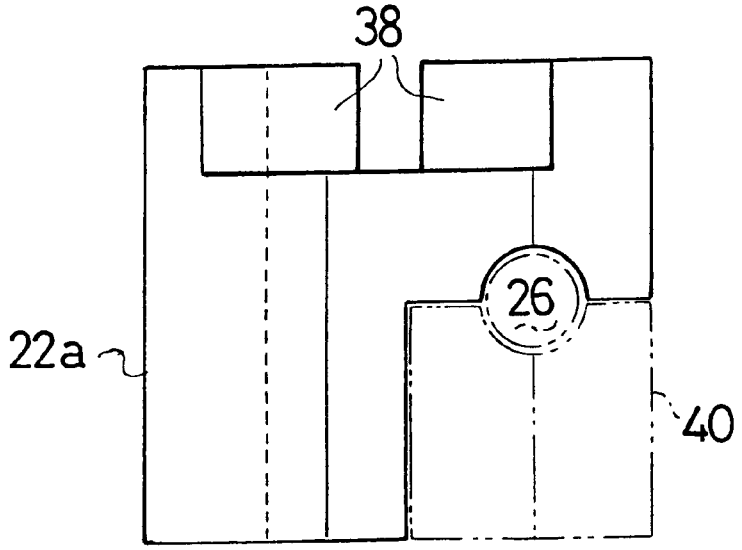
FIG. 13 is a view taken in a direction of an arrow XIII in FIG. 11, wherein a stay 40 is drawn in phantom lines.
Figure 14:
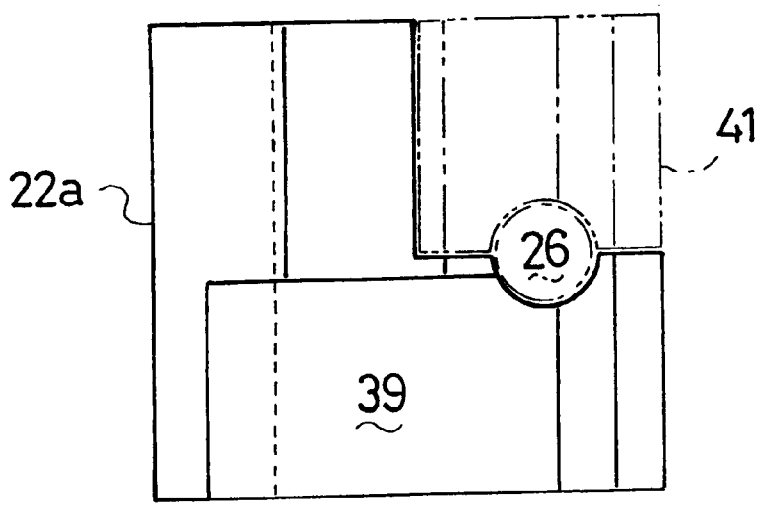
FIG. 14 is a view taken in a direction of an arrow XIV in FIG. 11, wherein a stay 41 is drawn in phantom lines.

The follower shaft 26 is supported by the C-shaped sliding bracket 22 as shown in FIGS. 11 to 14 comprising a base member 22*a* and two stays 40 and 41. As shown in FIGS. 13 and 14, two opposite end portions of the base member 22*a* are cut away so as to be narrowed. The cutaway surface of each end portion of the base member 22*a* is provided therein with a sectionally semicircular groove in which each end of the follower shaft 26 is held. Each of the stays 40 and 41 is also provided therein with a sectional semicircular groove for coinciding with that of each end portion of the base member 22*a*.

For attaching the follower shaft 26 to the sliding bracket 22, each of opposite ends of the follower shaft 26 is inserted into the sectional semicircular groove on each of the end portions of the base member 22*a*, and each of the stays 40 and 41 is fitted into the vacant space adjacent to each end portion of the base member 22*a* so as to fit its sectional semicircular groove onto each end of the follower shaft 26 held in each of the sectional semicircular grooves of the base member 22*a*. Thus, each end of the follower shaft 26 is sandwiched between each of the end portions of the base member 22*a* and each of the stays 40 and 41. Finally, the stays 40 and 41 are screwed to the base member 22*a* so as to complete the sliding bracket 22 with the follower shaft 26 fixed thereto.

As shown in FIG. 12, the two ends of the follower shaft 26 are partly cut away for prevention of interference with the shaft casing 12 (13) and the later-discussed tapered block 24R (24L). Therefore, the follower shaft 26 are to be correctly disposed in its radial direction and fixed to the sliding bracket 22.

In FIGS. 11 and 12, the base member 22*a* of the sliding bracket 22 is provided at an approximately vertical and longitudinal middle portion thereof with a through hole 43 through which a bolt 28 is freely passed as discussed below. The diameter of the through hole 43 is sufficiently larger than that of the bolt 28 so as to allow the sliding bracket 22 to move crosswise to the bolt 28 during its sliding along the sloped face 44 of the triangular stay 45.

The base member 22*a* is provided at its suitable surface with an oil groove 42 and a drilled hole 63 in communication with the oil groove 42, such that lubricating oil can flow therethrough.

The base member 22*a* of the sliding bracket 22 is formed with two notches functioning as sliding surfaces during its motion almost along the bolt 28. One is a sliding surface 38 for slidably abutting against the sloped surface 44 of the triangular stay 45 secured onto the rear cover 4, and the other is a sliding surface 39 for slidably abutting against the tapered block 24R (24L) disposed under the sliding bracket 22. The through hole 43 is substantially a bisector of an angle made by the two sliding surfaces 38 and 39, i.e., an angle made by the sloped surface 44 of the triangular stay 45 and the sloped top surface of the tapered block 24R (24L). Also, the through hole 43 is perpendicular to the axis of the follower shaft 26. A top of one end of the sliding bracket 22 (the stay 40 and one end of the base member 22*a*) is partly cut away for prevention of interference with the shaft casing 12 (13). The other end of the sliding bracket 22 (the stay 41 and the other end of the base member 22*a*) is cut away so that, if the sliding bracket 22 is correctly located, the cutaway end surface is directed vertically, thereby preventing the corresponding ends of both the sliding brackets 22 from interference with each other.

Figure 15:
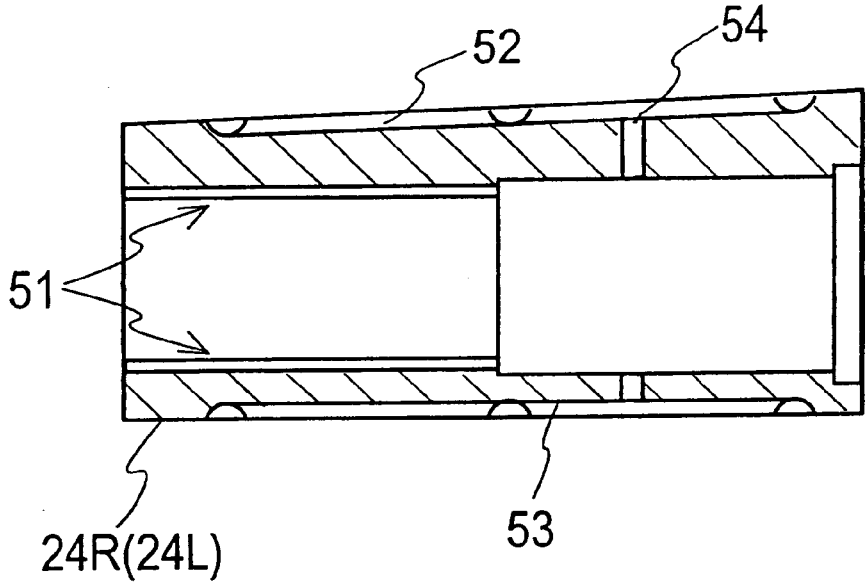
FIG. 15 is a sectional front view of a tapered block 24R of the reducing mill.

Referring to the right tapered block 24R as shown in FIG. 15, the tapered blocks 24L and 24R are sloped at their upper surfaces so as to slidably contact with the sliding surfaces 39 of the respective sliding brackets 22. A right-hand female 51 screw is processed in the right tapered block 24R and a left-hand female screw 51 is processed in the left tapered block 24L. As shown in FIG. 15, each of the tapered blocks 24L and 24R is provided at its top and bottom faces with oil grooves 52 and 53, respectively. The oil groove 52 is used for supplying lubricating oil between each of the sliding brackets 22 and each of the tapered blocks 24L and 24R. The oil groove 53 is for supplying that between each of the tapered blocks 24L and 24R and the main frame 2. Also, each of the tapered blocks 24L and 24R is vertically drilled by an oil hole 54 through its female-screwed hole for supplying lubricating oil between an adjusting screw shaft 27 disposed in the female-screwed hole and each of the tapered blocks 24L and 24R.

As shown in FIGS. 1 and 6, the tapered blocks 24L and 24R are mounted on the bottom surface of the lower chamber 2c of the main frame 2 so that their female-screwed holes are directed laterally and co-axially and their upper portions protrude into a lower space of the main chamber 2*a*. The top of outside end of each of the tapered blocks 24L and 24R is higher than the top of the inside end thereof, so that the top sloped surfaces of both the tapered blocks 24L and 24R are arranged in a laterally-widened V-like shape when viewed in front. An inner stopper 69 is disposed between the tapered blocks 24L and 24R so as to limit inward movements of the tapered blocks 24L arid 24R against each other. The adjusting screw shaft 27 is laterally inserted from the left or right (in this embodiment, left) opening of the lower chamber 2*c* into the lower chamber 2*c* so as to penetrate both the tapered blocks 24L and 24R through their female-screwed holes. A pair of outer stoppers 47 are fixed onto the adjusting screw shaft 27 so as to limit outward movements of the tapered blocks 24L and 24R away from each other.

The adjusting screw shaft 27 is provided thereon with a pair of left-hand and right-hand screws arranged symmetrically with respect to its intermediate portion disposed between the tapered blocks 24L and 24R. The two screws of the adjusting screw shaft 27 coincide with the respective female screws 51 of the left and right tapered blocks 24L and 24R. Therefore, if the adjusting screw shaft 27 is rotated in either of its opposite rotational directions, the tapered blocks 24L and 24R are moved simultaneously with each other along the adjusting screw shaft 27 in opposite directions.

When each of the left and right follower forming rolls 23 is disposed in each of the lower left and right portions of the main chamber 2*a* so as to make its follower bevel gear 21 mesh with each of the main bevel gears 20, the through hole 43 is approximately directed toward the axis of the pathway for the steel tube P and co-axially with the female screw 49*a* of the main frame 2. Then, the bolt 28 is directed radially of the follower shaft 26 (perpendicularly to the axis of the follower shaft 26), freely disposed through a spring 46 and the through hole 43 and screwed into the female screw 49*a* of the main frame 2 so as to project outwardly from the stay 49. The projecting end portion of the bolt 28 is thread-cut and provided thereon with a nut 28*a*, thereby being fastened onto the stay 49. The thickness of the sliding bracket 22 coincides with the distance between the front and rear covers 5 and 4, i.e., the thickness of the main frame 2, so that the sliding bracket 22 is prevented from a longitudinal slippage.

The spring 46 interposed between the head of the bolt 28 and the sliding bracket 22 biases the sliding bracket 22 downwardly slantwise toward the stay 49. Thus, if the tapered blocks 24L and 24R are moved away from each other, each of the sliding brackets 22 becomes movable downwardly to the degree corresponding to the lateral motion of each of the tapered blocks 24L and 24R, and each of the sliding brackets 22 naturally moves toward the stay 49 by the biasing force of the spring 46 along the sloped face 44 of the triangular stay 45 while the sliding surfaces 38 and 39 slide on the triangular stay 45 and the tapered block 24L or 24R, thereby moving the follower forming rolls 23 away from the main forming roll 19 along the tangents T. On the other hand, if the tapered blocks 24L and 24R are moved toward each other, the top sloped surface of each of the tapered blocks 24L and 24R pushes upwardly the bottom end of the sliding bracket 22, thereby sliding the sliding bracket 22 along the sloped face 44 toward the axis of the pathway for the steel tube P against the biasing force of the spring 46 so as to make the follower forming rolls 23 approach the main forming roll 19 along the tangents T.

As described above, the two sliding brackets 22 respectively incorporated into the left and right follower systems are slidden symmetrically with respect to the center of the main forming roll 19 and in the same movements by the rotation of the adjusting screw shaft 27. The range of the motion of the sliding bracket 22 toward the stay 49 is limited within a range of backlash of the meshing bevel gears 20 and 21 for prevention of cut of power transmission between the main and follower forming rolls 19 and 23.

When the left and right follower forming rolls 23 are located for determination of a caliber corresponding to the objective steel tube P, it is preferable that the tapered blocks 24L and 24R are previously set away from each other to some degree. A gauge stick having a diameter coinciding with the caliber is located just beneath the main forming roll 19, and then, the adjusting screw shaft 27 is rotated so as to move tapered blocks 24L and 24R toward each other, thereby moving the left and right follower forming rolls 23 together with their sliding brackets 22 toward the axis of the gauge stick till the left and right follower rolls 23 abut against the gauge stick.

During the process by the reducing mill 1, both the positions of the follower forming rolls 23 can be simultaneously adjusted only by rotation of the adjusting screw shaft 27 which is operated whether manually or automatically, whereby a diametrical reduction of the processed steel tube P can be adjusted easily and swiftly.

Although the preferred embodiment of the present invention in a state that is special to some extent has been described above, it will be obvious to those skilled in the art that the disclosure of the preferred embodiment may be changed in details of the structure, combinations and arrangement of parts, and the like without departing from the spirit and scope of the invention defined in the following claims.

What is claimed is:

1. A three-roll-type reducing mill for manufacture of electro-resistance-welded steel tubes, comprising:

three forming rolls including one positionally-fixed main forming roll and two positionally-adjustable follower forming rolls drivingly following said main forming roll, said three forming rolls being disposed at regular intervals so as to arrange the three axes of said three forming rolls in an equilaterally triangular shape, and brought into contact with an outer periphery of an electro-resistance-welded steel tube to be reduced with its diameter, and sliding means enabling both of said follower forming rolls to move simultaneously with each other and symmetrically with respect to a center of said main forming roll along respective tangents at the ends of a curve of said main forming roll for abutting against said electro-resistance-welded steel tube at two opposite ends of said main forming roll.

2. The three-roll-type reducing mill for electro-resistance-welded steel tube according to claim 1, further comprising:

a pair of left and right sliding brackets for respectively supporting said follower forming rolls;

an adjusting screw shaft, and a pair of left and right tapered blocks screwed onto said adjusting screw shaft so that, when said adjusting screw shaft is rotated, said pair of left and right tapered blocks are simultaneously moved oppositely to each other along said adjusting screw shaft whether toward each other or away from each other, wherein both said sliding brackets are in slidable contact with said respective tapered blocks so that said sliding brackets together with said follower forming rolls are moved along said respective tangents by the rotational operation of said adjusting screw shaft, thereby adjusting diametrical reduction of said electro-resistance-welded steel tube.

3. The three-roll-type reducing mill for electro-resistance-welded steel tube according to claim 2, further comprising:

sliding faces in parallel to said respective tangents, formed by said respective sliding brackets, and a pair of left and right sloped faces in parallel to said respective tangents, formed by a stand structure supporting said three forming rolls, wherein said sloped faces are brought into slidable contact with said sliding faces of said respective sliding brackets.

4. A three-roll-type reducing mill for manufacture of electro-resistance-welded steel tubes, comprising:

three forming rolls including one positionally-fixed main forming roll and two positionally-adjustable follower forming rolls drivingly following said main forming roll, said three forming rolls being disposed at regular intervals so as to arrange the three axes of said three forming rolls in an equilaterally triangular shape, and brought into contact with an outer periphery of an electro-resistance-welded steel tube to be reduced with its diameter;

sliding means enabling both of said follower forming rolls to move simultaneously with each other and symmetrically with respect to a center of said main forming roll along respective tangents to a curve of said main forming roll for abutting against the electro-resistance-welded steel tube at two opposite ends of said main forming roll;

a pair of left and right sliding brackets for respectively supporting said follower forming rolls;

an adjusting screw shaft; and a pair of left and right tapered blocks screwed onto said adjusting screw shaft so that when said adjusting screw shaft is rotated, said pair of left and right tapered blocks simultaneously move opposite to each other along said adjusting screw shaft, where in both said sliding brackets are in slidable contact with said respective tapered blocks so that said sliding brackets and said follower forming rolls are moved together along said respective tangents by the rotational operation of said adjusting screw shaft, thereby adjusting diametrical reduction of the electro-resistance-welded tube.

5. The three-roll-type reducing mill of claim 4, further comprising:

sliding faces in parallel to said respective tangents, formed by said respective sliding brackets; and a pair of left and right sloped faces in parallel to said respective tangents, formed by a stand structure supporting said three forming rolls, wherein said sloped faces are brought into slidable contact with said sliding faces of said respective sliding brackets.

* * * * *